US008585039B2

(12) United States Patent
Murata

(10) Patent No.: US 8,585,039 B2
(45) Date of Patent: Nov. 19, 2013

(54) RECORDING APPARATUS

(75) Inventor: Satoshi Murata, Okazaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 231 days.

(21) Appl. No.: 13/074,551

(22) Filed: Mar. 29, 2011

(65) Prior Publication Data

US 2012/0074641 A1 Mar. 29, 2012

(30) Foreign Application Priority Data

Sep. 28, 2010 (JP) ..... 2010-216637

(51) Int. Cl.
*B65H 3/00* (2006.01)

(52) U.S. Cl.
USPC ..... 271/18; 271/109; 271/121; 271/125

(58) Field of Classification Search
USPC ..... 271/18, 273, 109, 124, 121, 125
See application file for complete search history.

(56) References Cited

U.S. PATENT DOCUMENTS

| | | | | |
|---|---|---|---|---|
| 7,992,859 | B2 * | 8/2011 | Shiina | 271/109 |
| 2007/0145666 | A1 * | 6/2007 | Nishikata et al. | 271/18 |
| 2009/0267293 | A1 * | 10/2009 | Watanabe et al. | 271/264 |
| 2009/0295069 | A1 | 12/2009 | Shiina | |

FOREIGN PATENT DOCUMENTS

| | | | |
|---|---|---|---|
| JP | 2001-270626 | A | 10/2001 |
| JP | 2002-060066 | A | 2/2002 |
| JP | 2003-201045 | | 7/2003 |
| JP | 2004-299825 | | 10/2004 |
| JP | 2009-286594 | A | 12/2009 |

OTHER PUBLICATIONS

JP Decision to Grant mailed Jun. 19, 2012, JP application 2010-216637, English translation.

* cited by examiner

*Primary Examiner* — Michael McCullough
*Assistant Examiner* — Howard Sanders
(74) *Attorney, Agent, or Firm* — Banner & Witcoff, Ltd.

(57) ABSTRACT

A recording apparatus including: a roller disposed at a set position and configured to convey a recording medium; a shaft member configured to support the roller located at the set position, wherein the roller is disengageable from the shaft member by moving in a direction toward one of opposite ends of the shaft member; a roller moving mechanism configured to move the roller in the direction toward the one end by applying a force to the roller in the direction toward the one end; and a movement inhibiting and allowing member configured to: inhibit the roller from moving in the direction toward the one end by being positioned at a first position at which the roller is positioned where the roller has been moved in the direction toward the one end; and allow the roller to move in the direction toward the one end by moving from the first position to a second position different from the first position.

18 Claims, 5 Drawing Sheets

RECORDING APPARATUS

CROSS REFERENCE TO RELATED APPLICATION

The present application claims priority from Japanese Patent Application No. 2010-216637, which was filed on Sep. 28, 2010, the disclosure of which is herein incorporated by reference in its entirety.

BACKGROUND OF THE INVENTION

1. Field of the Invention

The present invention relates to a recording apparatus configured to record an image on a recording medium.

2. Description of the Related Art

There is known a sheet-supply device including a retard unit having a guide arm for guiding a sheet and for holding a shaft of a retard roller (a retard-roller shaft). On the guide arm of the retard unit, there are provided the retard roller, the retard-roller shaft for supporting the retard roller, and a removable cover. A user can remove the retard roller from the retard-roller shaft to replace the retard roller by removing the cover and sliding the retard roller toward the cover.

SUMMARY OF THE INVENTION

However, in the above-described sheet-supply device, even where the user has removed the cover to replace the retard roller, the retard roller remains at a specific position of the retard-roller shaft. In order to remove the retard roller from the retard-roller shaft, the user needs to enter his or her hand or finger(s) from an opening formed by removing the cover and then slide the retard roller along the retard-roller shaft from the specific position. Thus, it is very burdensome for the user to replace the retard roller.

This invention has been developed in view of the above-described situations, and it is an object of the present invention to provide a recording apparatus that enables a user to easily replace a roller.

The object indicated above may be achieved according to the present invention which provides a recording apparatus comprising: a roller disposed at a set position and configured to convey a recording medium; a shaft member configured to support the roller located at the set position, wherein the roller is disengageable from the shaft member by moving in a direction toward one of opposite ends of the shaft member; a roller moving mechanism configured to move the roller in the direction toward the one end of the shaft member by applying a force to the roller in the direction toward the one end; and a movement inhibiting and allowing member configured to: inhibit the roller from moving in the direction toward the one end by being positioned at a first position as a movement position at which the roller is positioned where the roller has been moved in the direction toward the one end; and allow the roller to move in the direction toward the one end by moving from the first position to a second position different from the first position.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DETAILED DESCRIPTION OF THE EMBODIMENT

Hereinafter, there will be described an embodiment of the present invention by reference to the drawings.

Figure 1:
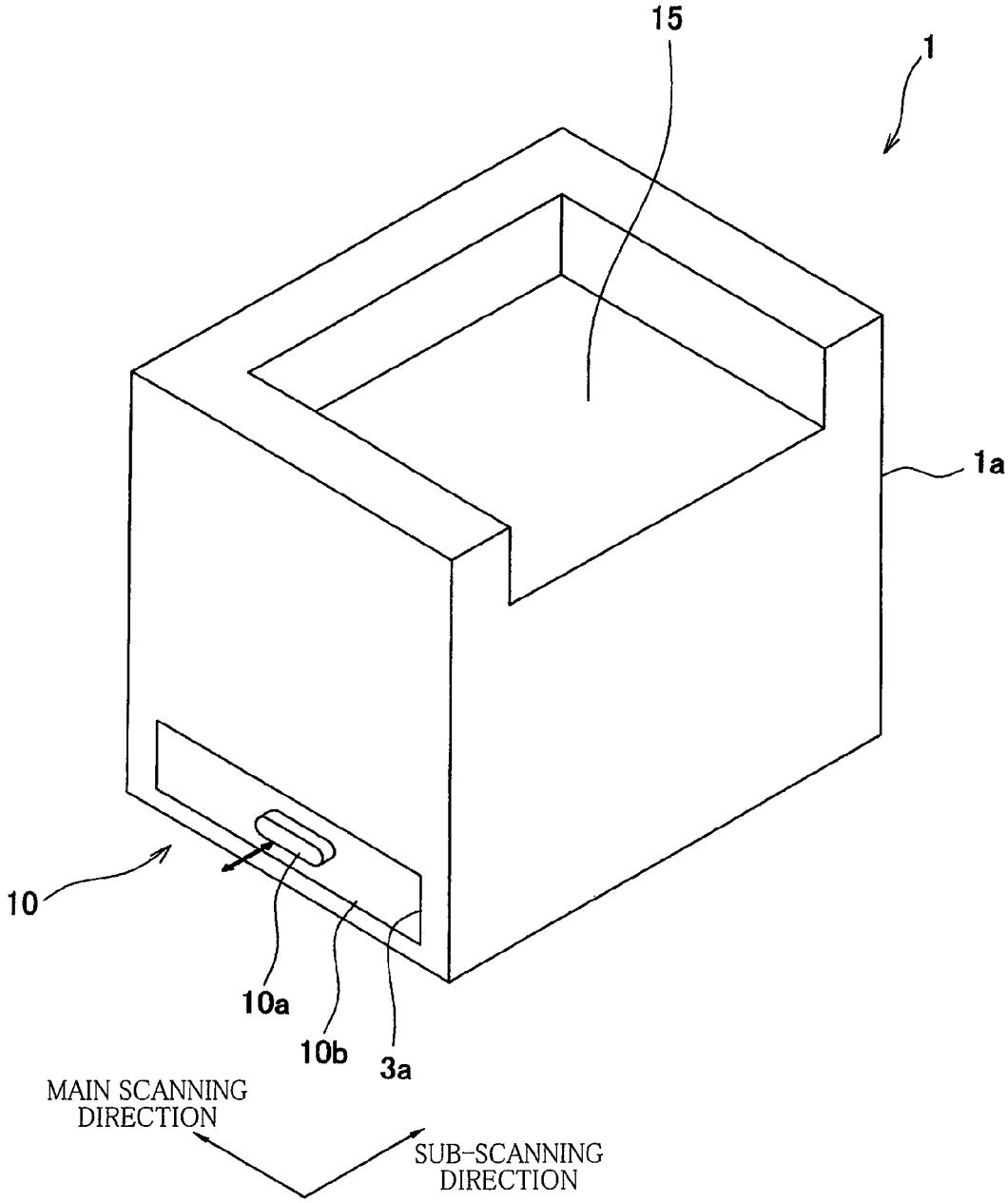
FIG. 1 is an external perspective view showing an ink-jet printer as an embodiment of the present invention.
Figure 2:
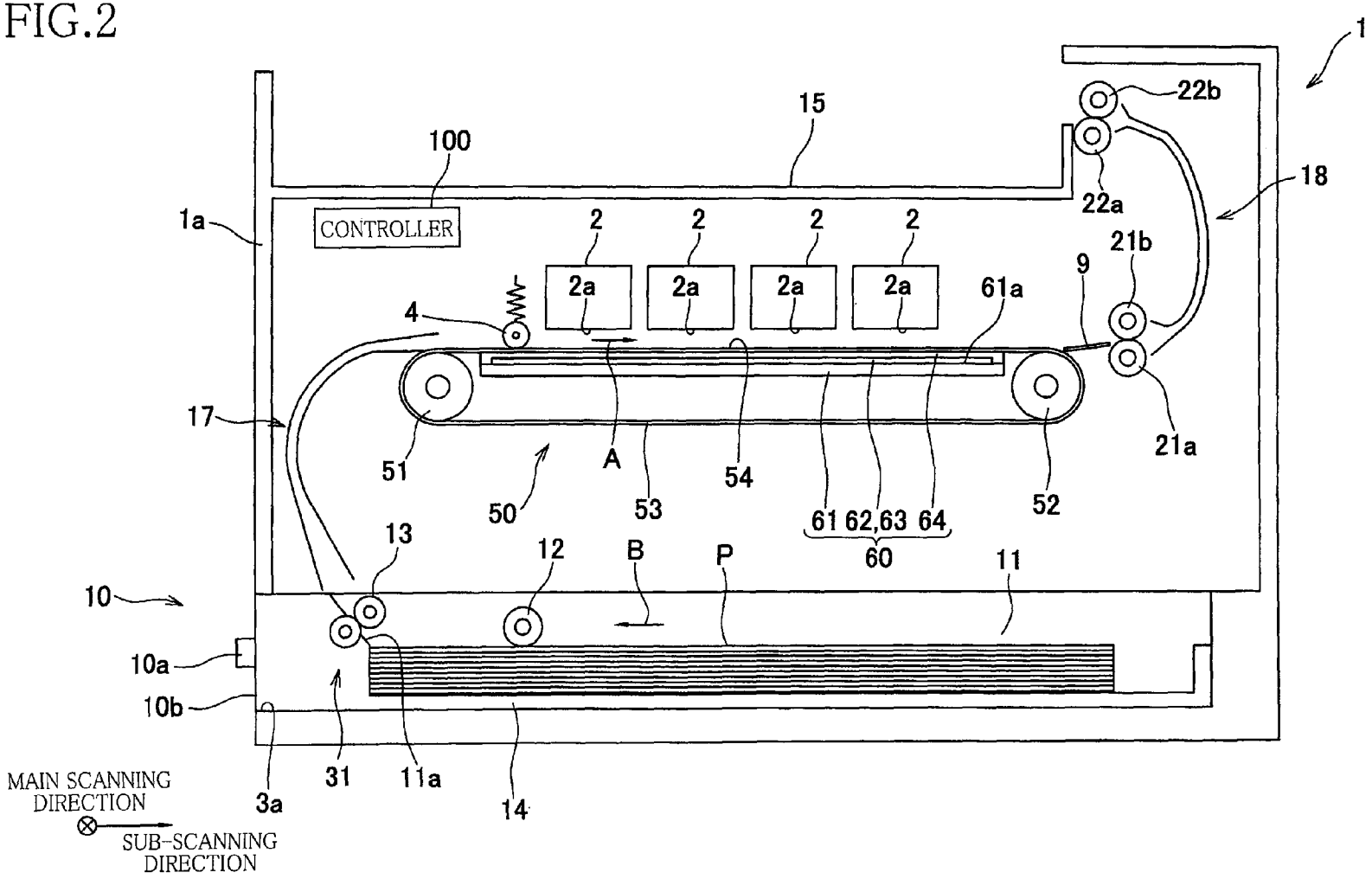
FIG. 2 is a side view generally showing an internal structure of the printer shown in FIG. 1.

As shown in FIGS. 1 and 2, an ink-jet printer 1 as the present embodiment includes a casing 1*a* having a rectangular parallelepiped shape. As shown in FIG. 2, the ink-jet printer 1 is a color ink-jet printer including four ink-jet heads 2 respectively ejecting inks of respective four colors, namely, magenta, cyan, yellow, and black. In this printer 1, a sheet-supply cassette 10 as one example of a supply tray is disposed at a lower portion thereof in FIG. 2, and a sheet-discharge portion 15 is provided at an upper portion thereof in FIG. 2. A sheet feeding unit 50 for feeding or conveying a sheet P in a feeding direction A is provided between the sheet-supply cassette 10 and the sheet-discharge portion 15. Further, the printer 1 includes a controller 100 configured to control operations of the printer 1.

As shown in FIG. 1, the casing 1*a* has an opening 3*a* formed at a front side thereof (i.e., a left and front face in FIG. 1). The sheet-supply cassette 10 is inserted into and mounted on the casing 1*a* through the opening 3*a*. In the present embodiment, the sheet-supply cassette 10 can be inserted into and removed from the casing 1*a* in a sub-scanning direction.

Each of the four ink-jet heads 2 has a generally rectangular parallelepiped shape elongated in a main scanning direction, and the heads 2 are arranged in the sub-scanning direction. That is, this printer 1 is a line printer. It is noted that, in the present embodiment, the sub-scanning direction is a direction parallel to the feeding direction A in which the sheet P is fed, and the main scanning direction is a direction perpendicular to the sub-scanning direction and along a horizontal plane.

Each of the heads 2 includes a laminar body, not shown, having (a) a channel unit in which are formed ink channels respectively including pressure chambers and (b) actuators adhering to the channel unit for applying pressures to the ink in the respective pressure chambers. Each head 2 has a bottom face functioning as an ink-ejection face 2*a* for ejecting the ink. The ink-ejection face 2*a* has a multiplicity of ink-ejection openings, not shown, through which the ink is ejected. The ink-ejection face 2*a* has a length slightly larger than the sheet P in the main scanning direction, allowing non-margin recording in which an image is recorded on an entire face of the sheet P.

Figure 3:
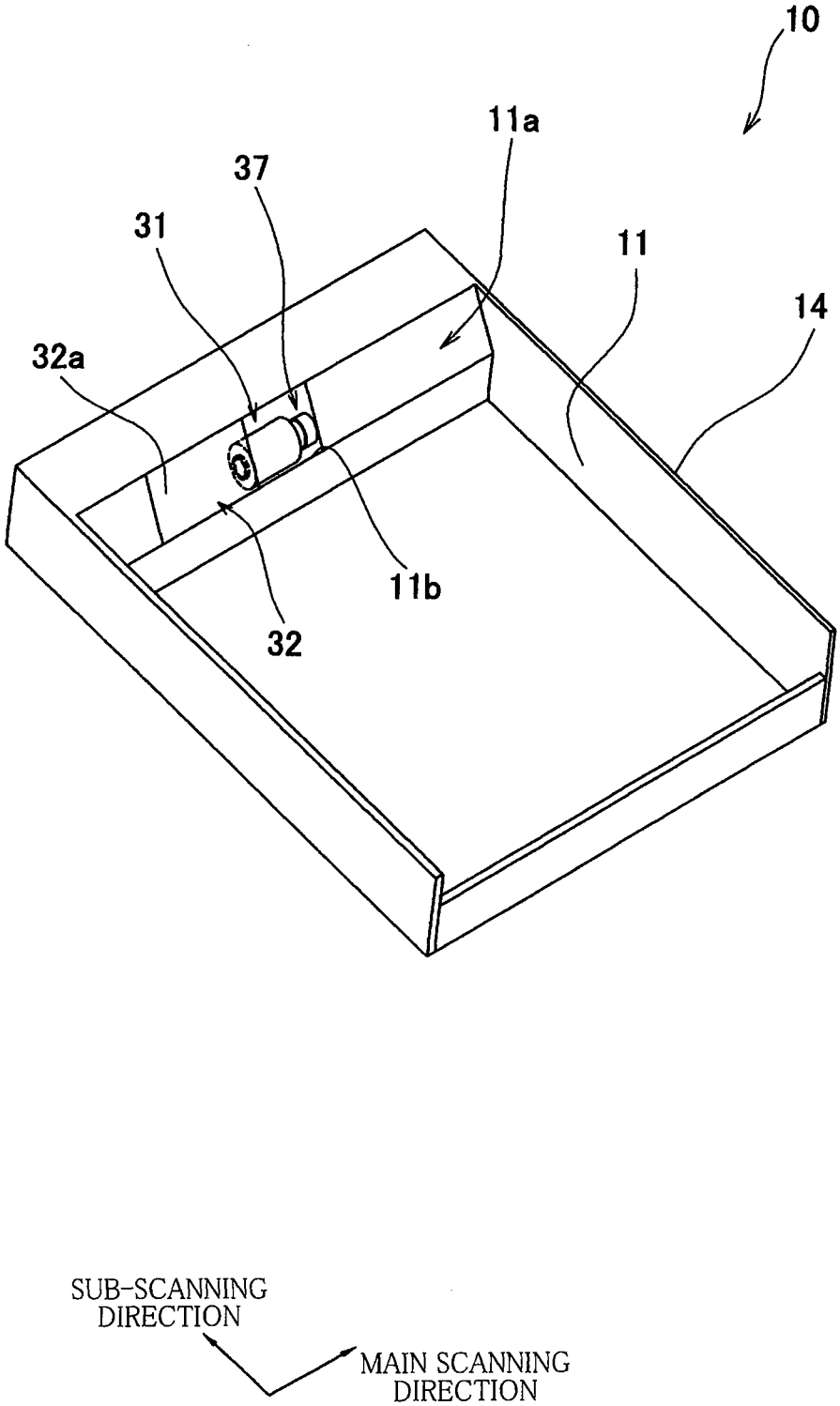
FIG. 3 is a perspective view generally showing a sheet-supply cassette shown in FIG. 1.

As shown in FIGS. 2 and 3, the sheet-supply cassette 10 includes a frame 14 having a recessed portion 11 (as one example of an accommodating portion) opening upward. The cassette 10 can accommodate a plurality of the sheets P stacked in the recessed portion 11. Further, as shown in FIG. 2, when mounted on the casing 1*a* from the opening 3*a*, the sheet-supply cassette 10 is disposed at a position overlapping the sheet feeding unit 50 in an upward and downward direction.

In the casing 1*a*, there are provided a sheet-supply roller 12, a sheet-feed roller 13, a drive motor, not shown, for driving the sheet-supply roller 12 and the sheet-feed roller 13. The sheet-supply roller 12 is brought into contact with an uppermost one of the sheets P accommodated in the sheet-supply cassette 10 while rotating to supply the sheet P to the sheet-feed roller 13. The sheet-feed roller 13 contacts the sheet P supplied by the sheet-supply roller 12 so as to nip the sheet P with a retard roller 31 which will be described below, and the roller 13 is rotated to feed the sheet P from the sheet-supply cassette 10. It is noted that the drive motor is controlled by the controller 100. On an upper side of a left end portion of the sheet-supply cassette 10 in FIG. 2, there is provided a sheet feeding guide 17 curving and extending from the sheet-supply cassette 10 toward the sheet feeding unit 50.

In this construction, when the controller 100 has controlled the sheet-supply roller 12 and the sheet-feed roller 13 to rotate in a clockwise direction in FIG. 2, the sheet P is supplied and fed by the sheet-supply roller 12 and the sheet-feed roller 13 to the sheet feeding unit 50 through the sheet feeding guide 17.

As shown in FIG. 2, an inclined face (plate) 11*a* for guiding the sheet P to the sheet feeding guide 17 is provided on a front end portion of the recessed portion 11 (a left end portion thereof in FIG. 2) in a direction B in which the sheet P is supplied from the sheet-supply cassette 10 (that is, the direction B is a direction opposite to the feeding direction A). The retard roller 31 and a chute 32 as one example of a movement inhibiting and allowing member is provided on the front end portion of the frame 14 in the direction B. The chute 32 for guiding the fed sheet P is disposed so as to close part of an opening 11*b* formed in the inclined face 11*a*. That is, the chute 32 functions as a part of a guide member for guiding the sheet fed from the sheet-supply cassette 10. The retard roller 31 is disposed such that a roller surface thereof projects from the opening 11*b* between the chute 32 and the inclined face 11*a*. That is, the retard roller 31 is disposed so as to be enabled to nip the sheet P fed along the inclined face 11*a*, with the sheet-feed roller 13. It is noted that FIGS. 4A, 4B, and 5 are perspective views each showing a front end portion of the sheet-supply cassette 10 seen from a front side thereof in a state in which a decorative plate 10*b* and a handle 10*a* provided thereon (see FIGS. 1 and 2) are removed.

Figure 4A:
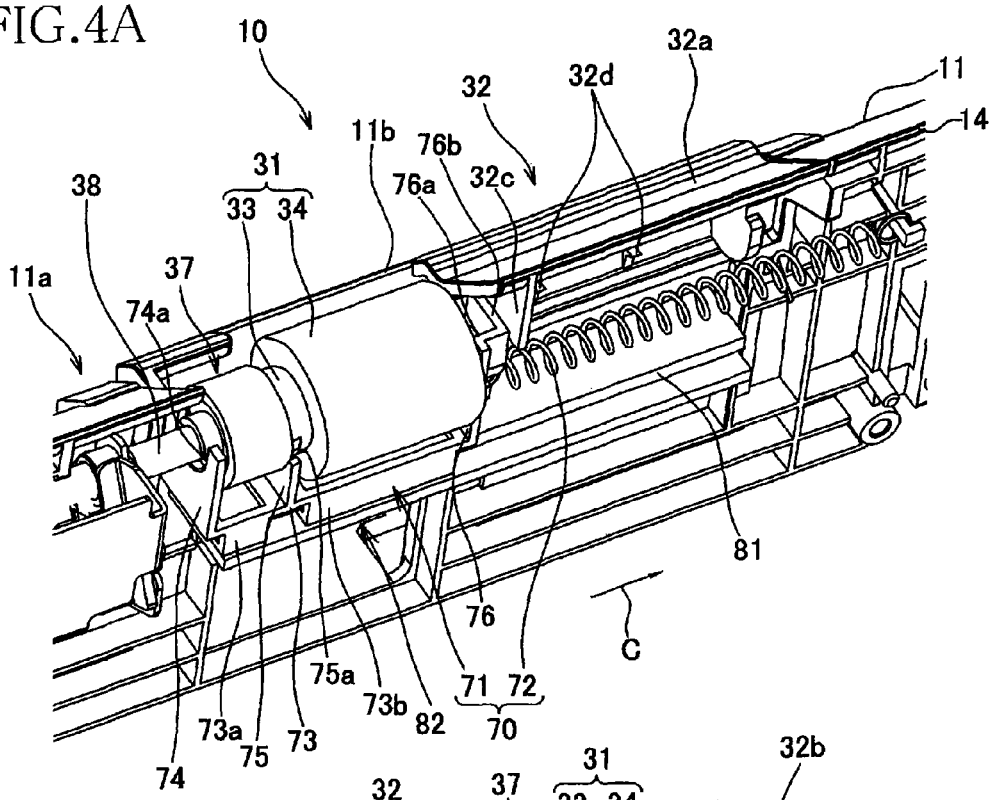
FIG. 4A is a perspective view showing a retard roller and a torque limiter disposed at a set position and a chute disposed at a positioning position.
Figure 4B:
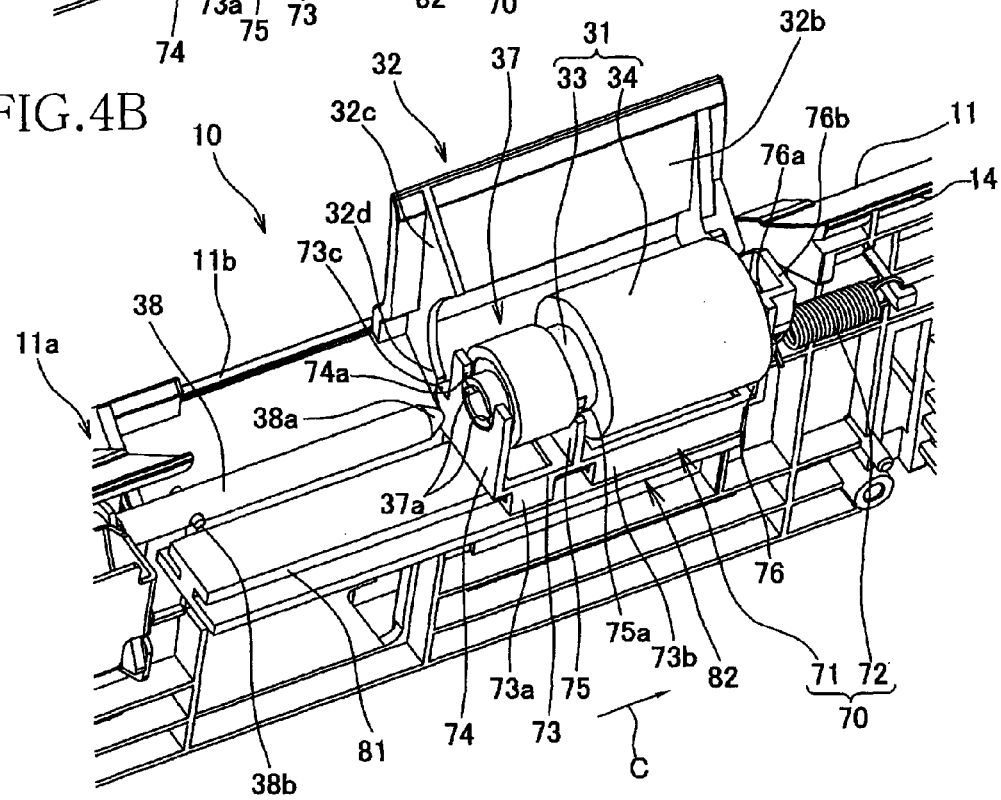
FIG. 4B is a perspective view showing the retard roller and the torque limiter disposed at a replacement position and the chute disposed at a disengagement position.

As shown in FIGS. 4A and 4B, the chute 32 is supported on the frame 14 so as to be pivotable about a portion of the frame 14 near a lower end of the opening 11*b*. Specifically, the chute 32 is movable between (a) a positioning position as a first position (see FIG. 4A) at which a front face 32*a* of the chute 32 is located on the same plane as the inclined face 11*a* and at which the retard roller 31 is positioned at a set position (which will be described below) and (b) a disengagement position as a second position (see FIG. 4B) at which the front face 32*a* is not located on the same plane as the inclined face 11*a* and at which the positioning of the retard roller 31 at the set position is released such that the retard roller 31 is movable to the positioning position of the chute 32. As a result, where the chute 32 has been positioned at the position at which the front face 32*a* is located on the same plane as the inclined face 11*a*, i.e., the first position (a movement position) at which the retard roller 31 is moved by an urging mechanism 70 which will be described below, a rightward movement of the retard roller 31 in FIGS. 4A and 4B is inhibited or restricted. Where the chute has been moved to the position at which the front face 32*a* is not located on the same plane as the inclined face 11*a*, i.e., a position (the second position) other than the movement position, the rightward movement of the retard roller 31 in FIGS. 4A and 4B is allowed. It is noted that, when the chute 32 is located at the positioning position, no step is formed between the inclined face 11*a* and the front face 32*a*, that is, the inclined face 11*a* and the front face 32*a* are flush with each other, thereby effectively guiding the fed sheet P. The chute 32 is always urged or biased by a torsion coil spring, not shown, so as to be located at the positioning position. The chute 32 is thus disposed at the positioning position without rattling. It is noted that, as shown in FIG. 4A, when the chute 32 is located at the positioning position, the chute 32 is located next to the retard roller 31 on a left side thereof, and as shown in FIG. 4B, a length of a shaft member 38 of the chute 32 in an axial direction thereof is generally the same as that of the retard roller 31 and a torque limiter 37 (which will be described below) in the axial direction. Further, as shown in FIG. 4B, where the chute 32 is located at the second position, the retard roller 31 and the torque limiter 37 are located at a position of the chute 32 located at the first position in the axial direction of the shaft member 38 of the chute 32. It is noted that the length of the shaft member 38 of the chute 32 in the axial direction may be larger than that of the retard roller 31 and the torque limiter 37 in the axial direction.

Figure 5:
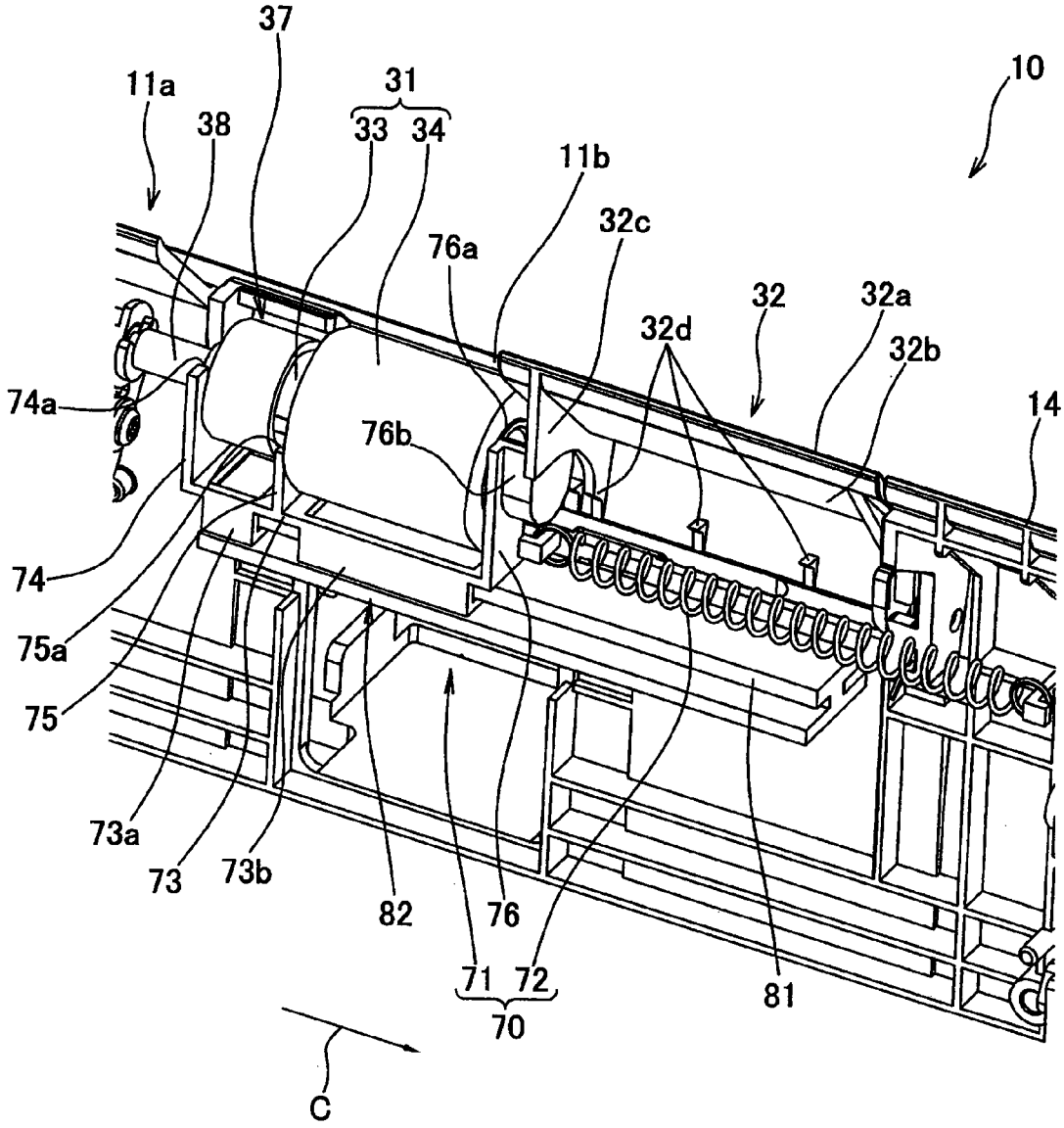
FIG. 5 is a perspective view showing the retard roller and the torque limiter disposed at the set position and the chute disposed at the positioning position.

As shown in FIGS. 4A, 4B, and 5, the shaft member 38, the urging mechanism 70, and the torque limiter 37 are provided on the front end portion of the frame 14. The shaft member 38 supports the retard roller 31 such that the retard roller 31 is slidable in the axial direction of the shaft member 38 (i.e., a direction parallel to the main scanning direction). The urging mechanism 70 as one example of a roller moving mechanism urges the retard roller 31 in a direction C in which the retard roller 31 is pulled out or removed from the shaft member 38 (the direction C is parallel to the axial direction of the shaft member). The torque limiter 37 is supported on (inserted in) the shaft member 38 and connected to one end portion of the retard roller 31.

The retard roller 31 includes a sleeve 33 having a cylindrical shape and a covering member 34 covering an outer circumferential face of the sleeve 33. The covering member 34 is formed of an elastic material such as a resin or a rubber having flexibility. The covering member 34 covers an entire outer circumferential face of the sleeve 33 except opposite end portions thereof in the axial direction.

The shaft member 38 is formed by a circular cylindrical member extending in the direction C, and a diameter thereof is slightly smaller than an inside diameter of the sleeve 33. That is, the shaft member 38 supports the retard roller 31 such that the retard roller 31 is rotatable. As shown in FIG. 4B, a taper 38*a* is formed on a distal end portion of the shaft member 38, whereby the distal end portion thereof has a tapered shape. This makes it easier to insert the retard roller 31 and the torque limiter 37 into the shaft member 38 when the retard roller 31 and the torque limiter 37 are moved from a replacement position (which will be described below) to the set position. On the shaft member 38 are formed projections 38*b* projecting in a radial direction of the shaft member 38. The shaft member 38 is a part of a driving portion including: the above-described drive motor for rotating the sheet-supply roller 12 and the sheet-feed roller 13; and transmitting mechanisms, not shown, for transmitting a rotational power from the drive motor to the shaft member 38. It is noted that the transmitting mechanisms are provided respectively on the casing 1*a* and the sheet-supply cassette 10. These two transmitting mechanisms are connected to each other when the sheet-supply cassette 10 has been mounted on the casing 1*a*.

The rotational power from the drive motor is transmitted to the shaft member 38, thereby rotating the shaft member forwardly.

The torque limiter 37 has a cylindrical shape, and the other end portion thereof (i.e., a right end portion thereof in FIGS. 4A and 4B) is connectable to one end portion of the sleeve 33. On one end portion of the torque limiter 37 (i.e., a left end portion thereof in FIGS. 4A and 4B), there are formed grooves 37*a* which are respectively engaged or fitted on the projections 38*b* when the torque limiter 37 has been moved to the set position. As a result, the rotational power of the forward rotation of the shaft member 38 is transmitted to the torque limiter 37 and then to the retard roller 31. It is noted that a direction of this rotation of the retard roller 31 coincides with a direction of the rotation of the sheet-feed roller 13. Thus, a force for feeding the sheet P by the retard roller 31 acts in a direction opposite to the feeding direction in which the sheet P is fed by the sheet-feed roller 13.

The torque limiter 37 is configured such that, when a specific rotational power in a reverse rotational direction (i.e., a force for feeding the sheet P by the sheet-feed roller 13) has been applied to the retard roller 31, the retard roller 31 is rotated reversely relative to the shaft member 38. That is, where a plurality of the sheets P have been fed to between the retard roller 31 and the sheet-feed roller 13 at one time, the torque limiter 37 transmits the rotational power transmitted from the shaft member 38, to the retard roller 31 so as to rotate the retard roller 31 in the same direction as the sheet-feed roller 13. Thus, one of the fed sheets P which does not contact the sheet-feed roller 13 and contacts the retard roller 31 is returned or moved back into the recessed portion 11. When a single sheet P has been fed to between the sheet-feed roller 13 and the retard roller 31 and/or when the sheet-feed roller 13 and the retard roller 31 contact each other, the specific rotational power is applied to the retard roller 31, and thus a slippage is caused in the torque limiter 37, whereby the retard roller 31 is driven so as not to prevent the feeding of the sheet P by the sheet-feed roller 13. It is noted that the shaft member 38 is driven as in, the case where the sheet-supply roller 12 and the sheet-feed roller 13 are driven, and only in a case where a plurality of the sheets have been fed, the retard roller 31 is rotated in the same direction as the sheet-feed roller 13 to return unnecessary sheet(s) P to the recessed portion 11. As a modification, the shaft member 38 may be driven independently of the sheet-supply roller 12, and the sheet-feed roller 13.

The urging mechanism 70 includes: a holder 71 as one example of a contact portion for holding the retard roller 31 and the torque limiter 37; and a coil spring 72 as one example of an elastic member for urging or biasing the holder 71 in the direction C. It is noted that a member different from the coil spring 72 may be employed as the elastic member. On the front end portion of the frame 14 is provided a support member 81 having a rail shape for supporting the holder 71. The support member 81 extends in a direction parallel to the direction C so as to have an I-shape cross section. It is noted that, as shown in FIGS. 4A and 4B, the support member 81 supports the holder 71 from a lower side thereof during a period from a point in time when the chute 32 is located at the positioning position, that is, when the retard roller 31 is located at the set position, to a point in time when the chute 32 is located at the disengagement position, that is, the retard roller 31 is located at the replacement position that is a position of the retard roller 31 when the chute 32 is located at the positioning position.

The holder 71 includes: a main body 73 connected to the support member 81; and support portions 74-76 spaced from one another in the direction C and projecting from the main body 73 toward the torque limiter 37 and the retard roller 31. A sliding portion 82 is formed on the main body 73 and the support member 81 such that the holder 71 is slidable on the sliding portion 82 in a direction parallel to the direction C. The sliding portion 82 is constituted by (a) an upper portion of the support member 81 which has an I-shape cross section and (b) two pairs of gripping portions 73*a*, 73*b* formed on the main body 73, each pair having a three-sided rectangular shape. These gripping portions 73*a*, 73*b* grip or hold opposite portions of the upper portion of the support member 81 in a direction (i.e., the sub-scanning direction) perpendicular to a direction in which the support member 81 extends. It is noted that the sliding portion 82 may have any configuration as long as the holder 71 and the support member 81 are slidable relative to each other in the direction C. As shown in FIG. 4B, a projection 73*c* is formed on a face of the main body 73 near the recessed portion 11. The projection 73*c* extends in the direction C and has a length the same as that of the main body 73 in the direction C.

As shown in FIGS. 4A and 4B, the support portion 74 includes, at its upper portion, a curved portion 74*a* for supporting the one end portion of the torque limiter 37. A part of the upper portion of the support portion 74, which part is near the curved portion 74*a* is located at a position overlaying on the torque limiter 37 in the direction C. As shown in FIGS. 4A, 4B, and 5, a curved portion 75*a* is formed on an upper portion of the support portion 75 so as to support the one end portion of the retard roller 31 as a connecting portion of the torque limiter 37 and the retard roller 31. A part of the upper portion of the support portion 75, which part is near the curved portion 75*a* is located at a position overlaying on the retard roller 31 in the direction C. A curved portion 76*a* is formed on an upper portion of the support portion 76 so as to support the other end portion of the retard roller 31 (the sleeve 33). It is noted that a protective portion 76*b* for protecting the other end of the sleeve 33 is formed on a side face of the upper portion of the support portion 76, which side face faces in the direction C. Accordingly, when the contact of the protective portion 76*b* of the support portion 76 and a projection 32*c* which will be described below has been released, in other words, when the protective portion 76*b* and the projection 32*c* have been disengaged from each other, the upper portion of the support portion 74 urges a left face of the torque limiter 37 in FIGS. 4A, 4B, and 5 in the direction C, and the upper portion of the support portion 75 urges a left face of the retard roller 31 in FIGS. 4A, 4B, and 5 in the direction C. That is, until the contact of the protective portion 76*b* of the support portion 76 of the holder 71 and the projection 32*c* has been released, that is, when the chute 32 is located at the first position, the support portion 74 does not contact the left face of the torque limiter 37, the support portion 75 does not contact the left face of the retard roller 31, and the holder 71 does not urge the torque limiter 37 and the retard roller 31 in the direction C.

It is noted that, in the present embodiment, only the upper portion of the support portion 74 may urge the left face of the torque limiter 37 in the direction C. This is because the torque limiter 37 is located on an upstream side of the retard roller 31 in the direction C. However, where only the retard roller 31 is replaced, for example, only the upper portion of the support portion 75 needs only to urge the left face of the retard roller 31 in the direction C. Instead of the left face, the support portion may urge any side face as long as the side face faces in a direction opposite to the direction C. Where this printer 1 is configured in this manner, the contact of the support portion with the side face can move at least the retard roller 31 from the set position to the replacement position.

Here, the set position is a position shown in FIGS. 4A and 5 at which the retard roller 31 and the torque limiter 37 connected to each other are inserted into the shaft member 38 such that the one end portion of the retard roller 31 is inserted first, then an entirety of the retard roller 31 is supported on the shaft member 38, and the grooves 37*a* of the torque limiter 37 and the projections 38*b* of the shaft member 38 are engaged with each other. That is, owing to the rotational power from the shaft member 38 and the torque limiter 37, the retard roller 31 located at the set position can prevent a plurality of the sheets P from being fed at the same time by the sheet-feed roller 13 and can feed the sheet P with the sheet-feed roller 13. On the other hand, the replacement position is a position shown in FIG. 4B at which the retard roller 31 and the torque limiter 37 have been completely pulled out or removed from the shaft member 38 and at which the retard roller 31 and/or the torque limiter 37 can be replaced with new one(s).

Further, the support portions 74-76 support the torque limiter 37 and the retard roller 31 only where the torque limiter 37 and the retard roller 31 are located at the replacement position. Where located at the replacement position, the retard roller 31 and the torque limiter 37 are not supported by the shaft member 38 but supported by the support portions 74-76 (i.e., the curved portions 74*a*-76*a*). When the torque limiter 37 and the retard roller 31 have been moved together with the holder 71 from the replacement position to the set position, the torque limiter 37 and the retard roller 31 are supported by the shaft member 38 and then disengaged or moved off from the curved portions 74*a*-76*a*. It is noted that, where located at the set position, the protective portion 76*b* inhibits or limits the movement of the torque limiter 37 and the retard roller 31 in the direction C. Further, to the support portion 76 is fixed the other end of the coil spring 72 whose one end is fixed to the frame 14, so that the holder 71 is always urged from the set position toward the replacement position in the direction C. Thus, at the set position, the protective portion 76*b* contacts the projection 32*c* of the chute 32 located at the positioning position.

As shown in FIGS. 4B and 5, the projection 32*c* is formed on a back face 32*b* of the chute 32. The projection 32*c* projects from the back face 32*b* to such a position that the projection 32*c* contacts the protective portion 76*b*, where, as shown in FIG. 4A, the chute 32 has been positioned at the positioning position in a state in which the holder 71 is located at the set position together with the torque limiter 37 and the retard roller 31. That is, when the chute 32 is located at the first position, the projection 32*c* contacts the protective portion 76*b* of the holder 71, whereby the chute 32 inhibits the torque limiter 37 and the retard roller 31 from moving rightward in FIGS. 4A, 4B and 5. Thus, even where the holder 71 is being urged in the direction C, the chute 32 positions the torque limiter 37, the retard roller 31, and the holder 71 to the set position. It is noted that when the projection 32*c* has been moved to a position at which the projection 32*c* does not contact the protective portion 76*b*, that is, when the chute 32 has been moved to the disengagement position as shown in FIG. 4B, the torque limiter 37 and the retard roller 31 are automatically moved to the replacement position together with the holder 71 by an urging force of the coil spring 72. In other words, when the chute 32 is located at the second position, the projection 32*c* contacts the protective portion 76*b* of the holder 71, whereby the chute 32 allows the torque limiter 37 and the retard roller 31 to move rightward in FIGS. 4A, 4B and 5.

As shown in FIG. 5, on the back face 32*b* of the chute 32 are formed three engaging portions 32*d* spaced from one another in the direction C. An engaging portion 32*d* located on the most upstream side in the direction C among the three engaging portions 32*d* is formed integrally with the projection 32*c*. Where the chute 32 is located at the disengagement position while the holder 71 is located at the replacement position, these engaging portions 32*d* face and contact the projection 73*c*, thereby keeping the chute 32 at the disengagement position. As a result, the chute 32 is held by its engaging portions 32*d* at the disengagement position.

Here, there will be explained a method for replacing the retard roller 31 and/or the torque limiter 37. Where the retard roller 31 and/or the torque limiter 37 is replaced with new one(s), the sheet-supply cassette 10 is completely removed from the casing 1*a*, or the sheet-supply cassette 10 is pulled out from the casing 1*a* to a position at which components such as the chute 32 and the retard roller 31 are exposed to an outside. As shown in FIGS. 4A and 5, the retard roller 31, the torque limiter 37, and the holder 71 are normally positioned at the set position by the chute 32. Where the retard roller 31 and/or the torque limiter 37 is replaced, the user moves the chute 32 located at the positioning position by being urged by the torsion coil spring, to the disengagement position shown in FIG. 4B. As a result, the contact of the projection 32*c* and the protective portion 76*b* is released, that is, the projection 32*c* and the protective portion 76*b* are disengaged from each other, whereby the urging force of the coil spring 72 moves the holder 71 from the set position to the replacement position in the direction C. In this movement, since upper portions of the respective support portions 74, 75 respectively contact the respective side faces of the torque limiter 37 and the retard roller 31, the torque limiter 37 and the retard roller 31 are moved to the replacement position with the holder 71.

Where the holder 71 is located at the replacement position, the projection 73*c* and the engaging portions 32*d* are held in contact with each other, thereby holding the chute 32 at the disengagement position. Further, both of the torque limiter 37 and the retard roller 31 having been moved to the replacement position are completely removed from the shaft member 38 and supported on the holder 71. Thus, the user can replace at least one of the torque limiter 37 and the retard roller 31 supported by the holder 71 with new one(s), and then the user sets the torque limiter 37 and the retard roller 31 in reverse order to the above-described order. It is noted that the chute 32 is supported on the frame 14 at the position near the lower end of the opening 11*b* so as to be pivoted about an axis which is parallel with an axis of the shaft member 38. Where the chute 32 is located at the second position, as shown in FIG. 4B, the chute 32 is pivoted about the axis to a position in which upper portions of the retard roller 31 and the torque limiter 37 located at the replacement position are not covered by the chute 32 and are opened or exposed. That is, the disengagement position (i.e., the second position) of the chute 32 is a position at which the chute 32 has been pivoted to a state in which the upper portions of the retard roller 31 and the torque limiter 37 located at the replacement position are not covered by the chute 32 and are exposed upward. As a result, it becomes easier for the user to replace the retard roller 31 and/or the torque limiter 37.

That is, the user moves, in the direction opposite to the direction C, the holder 71 supporting the torque limiter 37 and the retard roller 31 which are connected to each other, that is, the user moves the holder 71 such that the torque limiter 37 and the retard roller 31 is inserted into the shaft member 38 such that the one end portion of the retard roller 31 is inserted first. When the torque limiter 37 and the retard roller 31 have reached the set position together with the holder 71, the engaging portions 32*d* and the projection 73*c* are disengaged from each other. When the engaging portions 32*d* and the projection 73*c* have been disengaged from each other, the chute 32 is automatically moved from the disengagement position to the positioning position by the urging force of the torsion coil spring. The chute 32 is thus disposed at the positioning position without rattling. As a result, a side face of the projection 32*c* which faces in the direction opposite to the direction C and a side face of the protective portion 76*b* which faces in the direction C are brought into contact with each other, whereby the torque limiter 37 and the retard roller 31 are positioned at the set position with the holder 71. The sheet-supply cassette 10 is then mounted on the casing 1*a* in this state, that is, the sheet-supply cassette 10 is mounted on the casing 1*a* after at least one of the torque limiter 37 and the retard roller 31 is replaced with new one(s), thereby making it possible to feed the sheet P accommodated in the sheet-supply cassette 10 to the sheet feeding unit 50 without feeding a plurality of the sheets P.

Returning to the explanation of FIG. 2, the sheet feeding unit 50 is disposed at a position facing the four ink-jet heads 2. The sheet feeding unit 50 includes: two belt rollers 51, 52; an endless sheet feeding belt 53 wound around the rollers 51, 52; a sheet feeding motor, not shown, controlled by the controller 100 to rotate the belt roller 52; and an adsorption (attraction) device 60. The two belt rollers 51, 52 are arranged in the feeding direction A.

The sheet feeding belt 53 is formed of, e.g., polyimide and fluoroplastic and has a flexibility and a volume resistivity of about between $10^8$-$10^{14}$ Ω·cm, but this sheet feeding belt 53 may be formed of any material as long as the sheet feeding belt 53 has such a volume resistivity and flexibility.

The adsorption device 60 includes: a base member 61 having a plate shape and formed of an insulating material; two electrodes 62, 63 bonded to an upper face 61*a* of the base member 61; and a protective film 64 bonded to the upper face 61*a* so as to cover an entirety of the electrodes 62, 63. Each of these electrodes 62, 63 includes a plurality of elongated portions extending in the feeding direction A. That is, each electrode 62, 63 has a comb-like shape in which the elongated portions of the electrode 62, 63 are alternately arranged in the sub-scanning direction. The electrodes 62, 63 are connected to a power source, not shown. It is noted that the power source is controlled by the controller 100.

The protective film 64 is formed of, e.g., polyimide and fluoroplastic and has a volume resistivity of about between $10^8$-$10^{14}$ Ω·cm, but this protective film 64 may be formed of any material as long as the protective film 64 has such a volume resistivity. It is noted that the adsorption device 60 is disposed at a position at which the protective film 64 is held in contact with an inner circumferential face of an upper portion of the sheet feeding belt 53, and the adsorption device 60 supports the sheet feeding belt 53 from an inside thereof. As a result, a sheet-feed face 54 of the upper portion of the sheet feeding belt 53 and the ink-ejection faces 2*a* of the respective heads 2 face and are parallel to each other so as to form a small space between the ink-ejection faces 2*a* and the sheet-feed face 54 of the sheet feeding belt 53. This space partly constitutes a sheet feeding path.

A nip roller 4 is disposed at a position corresponding to an upstream end of the adsorption device 60 so as to face the elongated portions of the electrodes 62, 63. The nip roller 4 presses the sheet P supplied from the sheet-supply cassette 10, onto the sheet-feed face 54.

In this construction, the belt roller 52 is rotated in the clockwise direction in FIG. 2 by the control of the controller 100, thereby rotating or circulating the sheet feeding belt 53. In this operation, the belt roller 51 and the nip roller 4 are also rotated in accordance with the rotation of the sheet feeding belt 53. Further, in this operation, different electric potentials are respectively applied to the electrodes 62, 63 by the control of the controller 100. For example, a positive or a negative potential is applied to the electrode 62, and a ground potential is applied to the electrode 63. When the electric potentials are thus applied to the respective electrodes 62, 63, a current flows or passes through the electrode 62, the protective film 64, the sheet feeding belt 53, and the sheet P in order, and then the current passes through the sheet feeding belt 53, the protective film 64, and the electrode 63 in order. As a result, positive or negative electric charges are generated at a portion of the sheet feeding belt 53 which faces the sheet P, thereby inducing electric charges having a polarity different from that of the sheet feeding belt 53, on a face of the sheet P which faces the sheet feeding belt 53. The different electric charges are attracted to each other, that is, an adsorption (attraction) force for adsorbing the sheet P to the sheet feeding belt 53 is generated.

The sheet P supplied from the sheet-supply cassette 10 is fed in the feeding direction A while being adsorbed to the sheet-feed face 54 of the sheet feeding belt 53 by the adsorption force generated by the adsorption device 60. When the sheet P fed while being adsorbed to the sheet-feed face 54 passes through positions just under the four ink-jet heads 2, the controller 100 controls the heads 2 to respectively eject the inks of respective four colors onto the sheet P. As a result, a desired color image is formed on the sheet P.

A peeling member 9 is provided at a position next to the sheet feeding unit 50 on a downstream side thereof in the feeding direction A. The peeling member 9 peels off the sheet P from the sheet-feed face 54 by entering, at a distal end of the peeling member 9, into a position between the sheet P and the sheet feeding belt 53. It is noted that, when a leading end of the sheet P reaches the peeling member 9, the adsorption force between the sheet-feed face 54 and the leading end of the sheet P has decreased. Thus, the sheet P is peeled off from the sheet-feed face 54 by the peeling member 9.

Between the sheet feeding unit 50 and the sheet-discharge portion 15 in the sheet feeding path, there are disposed (a) four sheet-feed rollers 21*a*, 21*b*, 22*a*, 22*b* and (b) a sheet feeding guide 18 located between the sheet-feed rollers 21*a*, 21*b* and the sheet-feed rollers 22*a*, 22*b*. The sheet-feed rollers 21*b*, 22*b* are rotatable by a sheet feeding motor, not shown, controlled by the controller 100. When the sheet-feed rollers 21*b*, 22*b* have been rotated by the controller 100, the sheet P fed from the sheet feeding unit 50 is fed upward in FIG. 2 by the sheet-feed rollers 21*a*, 21*b* while being guided by the sheet feeding guide 18. The sheet P is then fed to the sheet-discharge portion 15 by the sheet-feed rollers 22*a*, 22*b*. It is noted that each of the sheet-feed rollers 21*a*, 22*a* is a driven roller which is rotated according to the sheet feeding.

According to the printer 1 of the present embodiment, in the replacement of the retard roller 31, the user can move the retard roller 31 and the torque limiter 37 from the set position to the replacement position together with the holder 71 only by moving the chute 32 from the positioning position to the disengagement position. This makes it easier to replace the retard roller 31 and so on. Further, since the chute 32 is automatically moved from the disengagement position to the positioning position only by moving the holder 71 for supporting a newly set retard roller 31 and so on, from the replacement position to the set position, the user can easily perform the whole replacement operation of the retard roller 31 and so on. It is noted that, since the retard roller 31 of the sheet-supply cassette 10 is replaced at high frequency, the easy replacement of the retard roller 31 increases the convenience of the user.

Further, the urging mechanism 70 is constituted by the holder 71 and the coil spring 72, which provides a simple construction. Further, the three support portions 74-76 are formed on the holder 71, thereby supporting the retard roller 31 and the torque limiter 37 when the retard roller 31 and the torque limiter 37 are disposed at the replacement position. Further, on the holder 71 and the support member 81 is formed the sliding portion 82 on which the holder 71 is slidable in parallel with the sliding portion 82 in the direction C in a state in which the holder 71 and the sliding portion 82 are connected to each other. As a result, the holder 71 is less likely to be lost.

In the above-described embodiment, when the chute 32 is moved from the positioning position to the disengagement position, the torque limiter 37 and the retard roller 31 are moved to the replacement position together with the holder 71. In this movement, the retard roller 31 may not be completely or partly removed or pulled out from the shaft member 38. Also in this case, since the torque limiter 37 and the retard roller 31 are moved from the set position to the replacement position together with the holder 71, the user can easily move the torque limiter 37 and the retard roller 31 to the replacement position together with the holder 71. Thus, the user can easily replace the retard roller 31 and so on as in the case described above.

While the embodiment of the present invention has been described above, it is to be understood that the invention is not limited to the details of the illustrated embodiment, but may be embodied with various changes and modifications, which may occur to those skilled in the art, without departing from the spirit and scope of the invention. For example, in the above-described embodiment, at least one of the retard roller 31 and the torque limiter 37 is replaceable, but the present invention is not limited to this configuration. For example, this printer 1 may be configured such that only the retard roller 31 is replaceable. Further, the present invention may be applied for replacing the rollers (such as the sheet-feed rollers 21*a*, 21*b*, 22*a*, 22*b*) in the casing 1*a*. Further, the holder 71 may not support the retard roller 31 and so on having been moved to the replacement position. Further, instead of the holder 71, there may be employed a contact member which is supported by the support member 81 so as to be slidable in the direction C and which can contact at least a side face of the retard roller 31 which faces in the direction opposite to the direction C. In this case, the contact member and the coil spring 72 as the elastic member are connected to each other.

Further, in the above-described embodiment, the retard roller 31 is constituted by the sleeve 33 and the covering member 34 but may be constituted by one or more than two members. Further, the sliding portion 82 may not be formed on the holder 71 and the support member 81. Further, the support member 81 may not be formed. Further, instead of the chute 32, there may be employed a positioning member constituted by the projection 32*c* movable between (a) the positioning position at which the retard roller 31 is positioned at the set position and (b) the disengagement position at which the positioning of the retard roller 31 at the set position is released and the retard roller 31 is movable to the replacement position, for example. Further, the engaging portions 32*d* may not be provided. Further, the taper 38*a* may not be formed on the distal end portion of the shaft member 38. Further, in the above-described embodiment, the torque limiter 37 is connected to the retard roller 31, but the present invention may be applied to a configuration having a retard roller to which the torque limiter 37 is not connected.

The present invention is applicable to any of a line printer and a serial printer. Further, the application of the present invention is not limited to the printer, and the present invention is applicable to a facsimile machine, a copying machine, and the like and applicable to a recording apparatus configured to perform recording by ejecting liquid other than the ink. Further, the application of the present invention is not limited to the ink-jet recording apparatus, and the present invention is applicable to a laser or thermal recording apparatus, for example. The recording medium is not limited to the sheet P, and various recording media may be used.

What is claimed is:

1. A recording apparatus comprising:

a roller disposed at a set position and configured to convey a recording medium;

a shaft member configured to support the roller located at the set position, wherein the roller is movable parallel to the shaft member between the set position and a disengaged position at which the roller is completely disengaged;

a roller moving mechanism configured to move the roller from the set position to the disengaged position in a direction toward one of opposite ends of the shaft member, the roller moving mechanism including an elastic member configured to apply force to the roller to move the roller on the shaft member in the direction toward the one end; and a movement inhibiting and allowing member movable between a first position and a second position, wherein the movement inhibiting and allowing member at the first position is located in a space in which the roller is positioned at the disengaged position, the movement inhibiting and allowing member being configured to:

when the movement inhibiting and allowing member is located at the first position, inhibit the elastic member from moving the roller in the direction toward the one end; and when the movement inhibiting and allowing member is moved from the first position to the second position, allow the elastic member to move the roller on the shaft member in the direction toward the one end until the roller is positioned at the disengaged position and disengaged from the shaft member.

2. The recording apparatus according to claim 1, wherein the movement inhibiting and allowing member is configured to position the roller at the set position when the movement inhibiting and allowing member is located at the first position, and wherein the movement inhibiting and allowing member is configured to release the positioning of the roller at the set position when the movement inhibiting and allowing member is located at the second position.

3. The recording apparatus according to claim 1, wherein the roller moving mechanism includes:

a force transfer member;

which is connected to the elastic member and via which the elastic member is configured to apply the force to the roller to move the roller on the shaft member in the direction toward the one end.

4. The recording apparatus according to claim 3, wherein the roller includes a sleeve into which the shaft member is inserted, and wherein the force transfer member includes a holder configured to support the sleeve when the roller has been disengaged from the shaft member.

5. The recording apparatus according to claim 4, wherein the roller is configured to be supported by the shaft member and not supported by the holder in a state in which the roller is located at the set position, and wherein the roller is configured to be supported by the holder and not supported by the shaft member in a state in which the roller is disengaged from the shaft member.

6. The recording apparatus according to claim 4, wherein, when the movement inhibiting and allowing member is located at the first position, the holder does not contact a side face of the roller which faces toward the other of the opposite ends of the shaft member, and wherein, when the movement inhibiting and allowing member is moved from the first position to the second position, the holder contacts the side face of the roller which faces toward the other end of the shaft member.

7. The recording apparatus according to claim 6, wherein the roller includes a torque limiter into which the shaft member is insertable, and the torque limiter is connectable to one of opposite end portions of the sleeve, which one is located nearer to the other end of the shaft member than the other end portion of the sleeve, wherein, when the movement inhibiting and allowing member is located at the first position, the holder does not contact a side face of the torque limiter or a side face of the sleeve, the side faces facing toward the other end of the shaft member, and wherein, when the movement inhibiting and allowing member is located at the second position, the holder contacts at least one of the side face of the torque limiter and the side face of the sleeve, the side faces facing toward the other end of the shaft member.

8. The recording apparatus according to claim 4, wherein the movement inhibiting and allowing member is configured to inhibit the roller from moving in the direction toward the one end by contacting a side face of the holder which faces toward the one end, when the movement inhibiting and allowing member is located at the first position.

9. The recording apparatus according to claim 4, wherein the movement inhibiting and allowing member is configured to allow the roller to move in the direction toward the one end by being disengaged from a side face of the holder which faces toward the one end, when the movement inhibiting and allowing member is moved from the first position to the second position.

10. The recording apparatus according to claim 4, further comprising a support member configured to support the holder from a lower side thereof, wherein the holder is configured to be slidable relative to the support member in an axial direction of the shaft member.

11. The recording apparatus according to 10, wherein the support member extends in the axial direction, and wherein the holder is configured to be supported by the support member when the roller is located at the set position and when the roller is moved in the direction toward the one end.

12. The recording apparatus according to claim 4, wherein the movement inhibiting and allowing member includes an engaging portion configured, when the movement inhibiting and allowing member is located at the second position, to hold the movement inhibiting and allowing member at the second position by being engaged with the holder supporting the roller which has been disengaged from the shaft member.

13. The recording apparatus according to claim 1, further comprising a supply tray capable of accommodating the recording medium, wherein the movement inhibiting and allowing member functions as a part of a guide member configured to guide the recording medium fed from the supply tray.

14. The recording apparatus according to claim 13, wherein the movement inhibiting and allowing member is configured to flush with the guide member when the movement inhibiting and allowing member is located at the first position.

15. The recording apparatus according to claim 1, wherein the shaft member has a taper formed on a one end portion of the shaft member, the taper having a tapered shape.

16. The recording apparatus according to claim 1, further comprising a supply tray capable of accommodating the recording medium, wherein the roller is a retard roller provided on the supply tray and configured to return, to the supply tray, the recording medium fed from the supply tray.

17. The recording apparatus according to claim 1, wherein, when the movement inhibiting and allowing member is located at the first position, the roller and the movement inhibiting and allowing member are arranged next to each other in an axial direction of the shaft member, wherein a length of the roller in the axial direction is the same as that of the movement inhibiting and allowing member in the axial direction, and wherein, when the movement inhibiting and allowing member is moved from the first position to the second position, the roller is moved by the roller moving mechanism to a position in the axial direction at which the movement inhibiting and allowing member had been located at the first position.

18. The recording apparatus according to claim 17, wherein the movement inhibiting and allowing member is pivotable about an axis parallel to the axial direction of the shaft member, and wherein the second position of the movement inhibiting and allowing member is a position at which an upper portion of the roller is exposed upward when the movement inhibiting and allowing member has been moved to the second position and thereby the roller has been moved to a position in the axial direction at which the movement inhibiting and allowing member had been located at the first position.

* * * * *